US011821052B2

(12) United States Patent
Guha et al.

(10) Patent No.: US 11,821,052 B2
(45) Date of Patent: Nov. 21, 2023

(54) METHOD FOR IMPROVING YIELD STRENGTH OF A WORKPIECE, AN APPARATUS AND A WORKPIECE THEREOF

(71) Applicant: TATA STEEL LIMITED, Jharkhand (IN)

(72) Inventors: Suman Guha, Jamshedpur (IN); Shaik Shamshoddin, Jamshedpur (IN); Rahul Kumar Verma, Jamshedpur (IN); Rudra Bubai Sarkar, Jamshedpur (IN)

(73) Assignee: TATA STEEL LIMITED, Jamshedpur (IN)

( * ) Notice: Subject to any disclaimer, the term of this patent is extended or adjusted under 35 U.S.C. 154(b) by 990 days.

(21) Appl. No.: 16/344,005

(22) PCT Filed: Dec. 27, 2017

(86) PCT No.: PCT/IB2017/058417
§ 371 (c)(1),
(2) Date: Apr. 22, 2019

(87) PCT Pub. No.: WO2019/116085
PCT Pub. Date: Jun. 20, 2019

(65) Prior Publication Data

US 2021/0355556 A1 Nov. 18, 2021

(30) Foreign Application Priority Data

Dec. 14, 2017 (IN) ..... 201731045065

(51) Int. Cl.
*B44B 5/00* (2006.01)
*C21D 9/46* (2006.01)
(Continued)

(52) U.S. Cl.
CPC ..... *C21D 9/46* (2013.01); *B21D 22/04* (2013.01); *B44B 5/0052* (2013.01); *B44B 5/026* (2013.01);
(Continued)

(58) Field of Classification Search
CPC .... B21D 22/104; B21D 13/02; B44B 5/0052; B44B 5/026; C22F 1/04; C21D 7/04; C21D 9/46; C21D 2221/00; B44C 1/24
See application file for complete search history.

(56) References Cited

U.S. PATENT DOCUMENTS 3,996,780 A 12/1976 German
5,025,547 A 6/1991 Sheu et al.
(Continued)

FOREIGN PATENT DOCUMENTS

JP H11-254067 A 9/1999
JP 11-319963 * 11/1999
(Continued)

OTHER PUBLICATIONS

International Preliminary Report on Patentability Chapter I for PCT Application No. PCT/IB2017/058417 dated Jun. 25, 2020.
(Continued)

*Primary Examiner* — Christopher E Mahoney
*Assistant Examiner* — Marissa Ferguson-Samreth

(57) ABSTRACT

The present disclosure discloses a method for improving yield strength of one or more workpieces. The method includes positioning the one or more workpieces in a punch and die assembly and operating the punch and die assembly such that, a plurality of surface protrusions are formed on the one or more workpieces. The plurality of surface protrusions are formed by plastic deformation on the one or more workpieces, to improve yield strength of the one or more workpieces. The present disclosure also provides an appa-
(Continued)

ratus to improve yield strength of the one or more workpieces. The present disclosure is configured to improve yield strength of the one or more workpieces, without altering its mechanical characteristics.

19 Claims, 11 Drawing Sheets

(51) Int. Cl.

| | |
|---|---|
| ***B21D 22/04*** | (2006.01) |
| ***C21D 7/04*** | (2006.01) |
| ***C22F 1/04*** | (2006.01) |
| ***B44C 1/24*** | (2006.01) |
| ***B44B 5/02*** | (2006.01) |
| *B21D 13/02* | (2006.01) |

(52) U.S. Cl.
CPC ..... *B44C 1/24* (2013.01); *C21D 7/04* (2013.01); *C22F 1/04* (2013.01); *B21D 13/02* (2013.01); *C21D 2221/00* (2013.01)

(56) References Cited

U.S. PATENT DOCUMENTS

| | | | |
|---|---|---|---|
| 6,185,977 | B1 | 2/2001 | Schiessl et al. |
| 2012/0181811 | A1 | 7/2012 | Fisk et al. |
| 2017/0254081 | A1 | 9/2017 | Castellucci |

FOREIGN PATENT DOCUMENTS

| | | | |
|---|---|---|---|
| JP | H11-319963 | A | 11/1999 |
| JP | 2001-001061 | A | 1/2001 |
| JP | 2004-174553 | A | 6/2004 |
| JP | 2015-000431 | A | 1/2015 |
| JP | 2017-530010 | A | 10/2017 |
| KR | 10-2012-0093272 | A | 8/2012 |
| WO | 2009/063154 | A1 | 5/2009 |

OTHER PUBLICATIONS

Extended European Search Report for European Application No. 17910502.8 dated Jun. 19, 2020.

Notice of Reasons for Refusal for Japanese Application No. 2018-565835 dated Jun. 2, 2020.

Request for the Submission of an Opinion for Korean Application No. 10-2018-7037098 dated Jan. 15, 2020.

Written Decision on Registration for Korean Application No. 10-2018-7037098 dated Jan. 20, 2021.

"[Encyclopedia of Science] ausformed steels," retrieved on Aug. 12, 2022, http://www.scienceall.com/%EC%98%A4%EC%8A%A4%ED%8F%BC%EB%93%9C%EA%B0%95ausformed-steels/#none.

PCT International Search Report and the Written Opinion dated May 23, 2018, issued in related International Application No. PCT/IB/2017/058417 (8 pages).

* cited by examiner

METHOD FOR IMPROVING YIELD STRENGTH OF A WORKPIECE, AN APPARATUS AND A WORKPIECE THEREOF

CROSS REFERENCE TO RELATED APPLICATIONS

This application is a national stage application under 35 U.S.C. § 371 of PCT Application No. PCT/IB2017/058417, filed Dec. 27, 2017, which claims priority of benefit to Indian Patent Application No. 201731045065, filed on Dec. 14, 2017, the contents of which are hereby incorporated by reference in their entirety.

TECHNICAL FIELD

Present disclosure generally relates to a field of manufacturing technology. Particularly, but not exclusively the present disclosure relates to a method for improving yield strength of one or more workpiece. Further, embodiments of the present disclosure disclose an apparatus for improving yield strength of the one or more workpiece.

BACKGROUND OF THE DISCLOSURE

Generally, in manufacturing industries, workpieces such as, but not limiting to, ingots, sheet materials and the like are used for manufacturing a product of desired dimensions. Manufacturing such a desired product may include use of single or multiple processes such as, but not limiting to, forming, stamping, blanking and like.

Over the decades, the realization to conserve energy resources has been paramount in the manufacturing sector. To cater to such requirements, manufacturing industries have shifted focus on utilising cutting-edge technology, which is energy efficient for manufacturing the desired product, while maintaining quality. Particularly, in automotive industries, everchanging safety regulations and stringent emission norms needs to be catered in order to stay ahead of competition. Automobile manufacturers utilise cutting edge techniques to obtain materials for automotive parts with high-strength to weight ratio. In other words, manufacturing lightweight components helps in weight reduction of the entire automobile, which inherently improves fuel economy and performance of the automobile.

Several conventional techniques are employed to obtain automotive parts and workpieces with high-strength to weight ratio. One such method being employed is heat treatment of the workpiece. Heat treatment includes heating material of the workpiece above its recrystallization temperature and cooling the heated material workpiece at a predetermined rate, to obtain desired material properties [i.e. microstructural changes or hardening or improving ductility of the workpiece]. This process ensures that the resultant workpiece is configured with a high strength to weight ratio. However, it is usually observed that, ductility of the workpiece gradually declines as the strength of the workpiece increases. Also, the heat treatment technique necessitates large amount of energy and time, which is undesirable.

Other common industrial practices, for enhancing mechanical properties of the workpieces include cold working (e.g. cold rolling, drawing, extrusions below recrystallization temperature of the workpiece), which exploits strain hardening phenomenon. These processes induce strain hardening on workpiece, and improve the yield strength. Sometimes micron sized features/structures on metallic surfaces exhibit strong response individually due to the size effect.

Size effect is commonly referred to as increase in strength of the workpiece, when it undergoes deformation in small volume, usually in the range of few microns and below. Many techniques are widely used to create such micron sized features which induces strain hardening and/or size effect. One such technique is laser surface texturing process. The laser surface texturing process produces micron sized dimples on the surface of the workpiece. However, this process of forming micro-texture on the workpiece becomes expensive due to utilization of precision instruments such as laser engraving machines and tool-room conditions.

To overcome the drawbacks in the laser surface texturing process, mechanical surface texturing methods were employed. This method includes rolling a textured roll on sheet materials of size 500 microns, resulting in micro-channels of depths ranging from about 5 microns to about 50 microns.

The present disclosure is directed to address one or more problems as discussed above.

The information disclosed in this background of the disclosure section is only for enhancement of understanding of the general background of the invention and should not be taken as an acknowledgement or any form of suggestion that this information forms the prior art already known to a person skilled in the art.

SUMMARY OF THE DISCLOSURE

One or more drawbacks of conventional systems and process for a method for improving yield strength of a workpiece and an apparatus are overcome, and additional advantages are provided through the apparatus and a method as claimed in the present disclosure. Additional features and advantages are realized through the technicalities of the present disclosure. Other embodiments and aspects of the disclosure are described in detail herein and are considered to be a part of the claimed disclosure.

In one non-limiting embodiment of the present disclosure, a method for improving yield strength of one or more workpieces is disclosed. The method includes positioning the one or more workpieces in a punch and die assembly and operating the punch and die assembly such that, a plurality of surface protrusions is formed on the one or more workpieces. The plurality of surface protrusions is formed by plastic deformation on the one or more workpieces, to improve yield strength of the one or more workpieces.

In an embodiment, at least one template mesh is provided selectively on at least one surface of each of the one or more workpieces.

In an embodiment, operating the punch and die assembly includes stamping, for imprinting a texture of a plurality of troughs over the at least one surface of the one or more workpieces.

In an embodiment, formation of the plurality of troughs induces a plurality of crests adjacent to the plurality of troughs, to form the plurality of surface protrusions.

In an embodiment, stamping includes imprinting configuration of the at least one template mesh over the at least one surface of the one or more workpieces.

In an embodiment, the plurality of troughs and the plurality of crests are configured to be at least one of symmetrical configuration and asymmetrical configuration.

In an embodiment, configuration of the at least one template mesh is defined on a punch.

In an embodiment, configuration of the punch includes at least one of a plurality of protrusions and a plurality of cavities.

In an embodiment, configuration of the at least one template mesh is defined on a die.

In an embodiment, configuration of the die includes at least one of the plurality of protrusions and the plurality of cavities.

In an embodiment, stamping of at least one of the plurality of protrusions and the plurality of cavities on at least one of the punch and the die forms the plurality of surface protrusions on the one or more workpieces.

In an embodiment, the at least one template mesh is provided between each of the one or more workpieces.

In an embodiment, operating the punch and the die assembly stamps the one or more workpieces to form the plurality of troughs, thereby forming the plurality of surface protrusions.

In an embodiment, providing the at least one template mesh includes, mounting the at least one template mesh on at least one of the punch and the die to form the plurality of surface protrusions.

In an embodiment, formation of the plurality of surface protrusions on the one or more workpieces improves yield strength of the one or more workpieces by at least 10%, in comparison to the one or more workpieces without the plurality of surface protrusions.

In an embodiment, the one or more workpieces is selected from at least one of a steel sheet, an aluminium sheet, a stainless-steel sheet or any other sheets thereof.

In an embodiment, the one or more workpieces is selected from at least one of a bare workpiece, a forming workpiece, a formed workpiece, a heat-treated workpiece or any other workpiece thereof.

In an embodiment, dimensions of the plurality of surface protrusions varies in the range of about 5 microns to about 100 microns and pitch of each of the plurality of surface protrusions varies in the range of about 10 microns to about 1000 microns.

In an embodiment, configuration of the at least one template mesh is selected from at least one of a square configuration, a triangular configuration, a rectangular configuration or any other configurations thereof.

In an embodiment, the at least one template mesh is detachable from at least one of the punch and the die.

In another non-limiting embodiment of the present disclosure, an apparatus for improving yield strength of the one or more workpieces is disclosed. The apparatus comprises the punch and die assembly mountable on a press. The punch and die assembly comprises a top bolster connected to the punch and a bottom bolster connected to the die. The die is configured to position one or more workpieces, such that the plurality of surface protrusions are formed on the at least one surface the one or more workpieces upon operating the punch and die assembly. The plurality of surface protrusions formed by plastic deformation on the at least one surface of the one or more workpieces improves yield strength of the one or more workpieces.

In another non-limiting embodiment, a workpiece is disclosed. The workpiece comprises a plurality of surface protrusions formed by plastic deformation induced by operating a punch and die assembly. The plurality of surface protrusions includes a plurality of troughs wherein the workpiece is configured with an increased yield strength of at least 10% in comparison to the workpiece without the plurality of surface protrusions.

It is to be understood that the aspects and embodiments of the disclosure described above may be used in any combination with each other. Several of the aspects and embodiments may be combined to form a further embodiment of the disclosure.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE ACCOMPANYING DRAWINGS

The novel features and characteristics of the disclosure are set forth in the appended description. The disclosure itself, however, as well as a preferred mode of use, further objectives and advantages thereof, will best be understood by reference to the following detailed description of an illustrative embodiment when read in conjunction with the accompanying figures. One or more embodiments are now described, by way of example only, with reference to the accompanying figures wherein like reference numerals represent like elements and in which:

FIG. 1 illustrates an apparatus for forming a plurality of surface protrusions on one or more workpieces, in accordance with an embodiment of the present disclosure.

FIG. 2*a* illustrates a punch and die assembly connectable to the apparatus of FIG. 1, in accordance with an embodiment of the present disclosure.

FIG. 2*b* illustrates the punch and die assembly connectable to the apparatus of FIG. 1, in accordance with an embodiment of the present disclosure.

Figure 1:
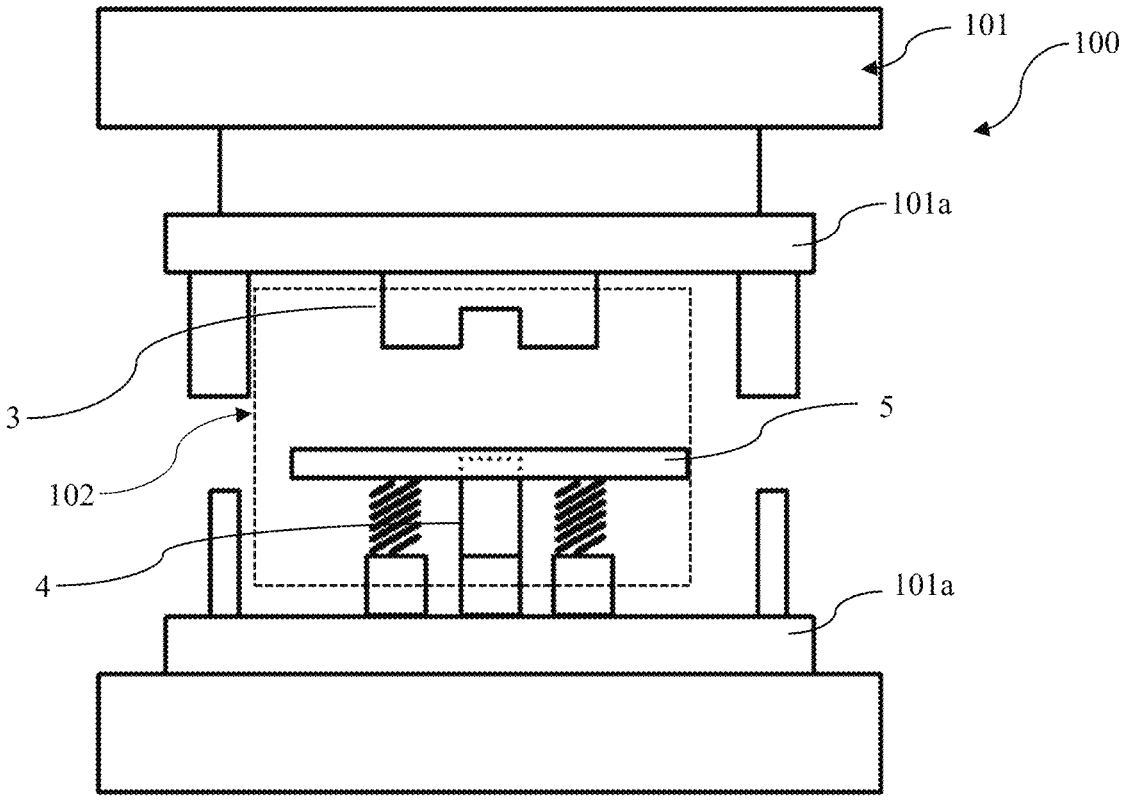

The figures depict embodiments of the disclosure for purposes of illustration only. One skilled in the art will readily recognize from the following description that alternative embodiments of the structures and methods illustrated herein may be employed without departing from the principles of the disclosure described herein.

DETAILED DESCRIPTION OF THE DISCLOSURE

While the embodiments of the disclosure are subject to various modifications and alternative forms, specific embodiment thereof have been shown by way of example in the figures and will be described below. It should be understood, however, that it is not intended to limit the disclosure to the particular forms disclosed, but on the contrary, the disclosure is to cover all modifications, equivalents, and alternative falling within the scope of the disclosure.

It is to be noted that a person skilled in the art would be motivated from the present disclosure to arrive at a method for improving yield strength of a workpiece and an apparatus thereof. Such a method for improving yield strength of a workpiece and the apparatus may vary based on configuration of one or more workpieces. However, such modifications should be construed within the scope of the disclosure. Accordingly, the drawings illustrate only those specific details that are pertinent to understand the embodiments of the present disclosure, so as not to obscure the disclosure with details that will be clear to those of ordinary skill in the art having benefit of the description herein.

The terms "comprises", "comprising", or any other variations thereof used in the disclosure, are intended to cover a non-exclusive inclusion, such that a device, system, assembly that comprises a list of components does not include only those components but may include other components not expressly listed or inherent to such system, or assembly, or device. In other words, one or more elements in a system or device proceeded by "comprises . . . a" does not, without more constraints, preclude the existence of other elements or additional elements in the system or device.

The present disclosure provides a method for improving yield strength of one or more workpieces. The method comprises positioning the one or more workpieces in a punch and die assembly and operating the punch and die assembly such that, a plurality of surface protrusions is formed on the one or more workpieces. The plurality of surface protrusions formed by plastic deformation improves yield strength of the one or more workpieces. The punch and die assembly imprints a plurality of troughs over at least one surface of the one or more workpieces. The plurality of troughs hence formed leaves behind a plurality of crests on the at least one surface of the one or more workpieces to form the plurality of surface protrusions. At least one template mesh may be provided selectively on the at least one surface of the one or more workpieces, so that the plurality of surface protrusions is formed corresponding to the configuration of the at least one template mesh. In an embodiment, the at least one template mesh may be mountable to the punch and die assembly, to form the plurality of surface protrusions on the one or more workpieces.

The present disclosure also provides an apparatus for improving yield strength of the one or more workpieces. The apparatus comprises the punch and die assembly mountable on a press. The punch and die assembly comprises a top bolster connected to the punch and a bottom bolster connected to the die. The die is configured to position the one or more workpieces, so that the plurality of surface protrusions are formed on the one or more workpieces, upon operation of the punch and die assembly. The plurality of surface protrusions are formed due to plastic deformation, thereby improving the yield strength of the one or more workpieces. The at least one template mesh is mountable on at least one of the punch and the die, to form the plurality of protrusions. In an embodiment, the punch and the die may include configuration of the at least one template mesh to form the plurality of surface protrusions, without utilizing the at least one template mesh. The punch and the die may include a configuration having a plurality of protrusions and a plurality of cavities to form the plurality of surface protrusions. This configuration of the apparatus upon operation forms the plurality of surface protrusions, which increases yield strength of the one or more workpieces by at least 10% in comparison to the yield strength of the one or more workpieces without the plurality of surface protrusions.

Further, the present disclosure also discloses one or more workpieces, having the plurality of surface protrusions formed by plastic deformation induced by operating the punch and die assembly. The plurality of surface protrusions includes the plurality of troughs, wherein the one or more workpieces is configured with increased yield strength of at least 10% in comparison to the yield strength of the workpieces without the plurality of surface protrusions.

The present disclosure is configured to improve yield strength of the one more workpieces by imprinting plurality of surface protrusions. This method for manufacturing enables to imprint plurality of protrusions on any portion of any surface of the one or more workpieces, and is therefore versatile, while being time efficient and economical. The method for the present disclosure also eliminates the need for expensive equipment for forming the plurality of surface protrusions.

The following paragraphs describe the present disclosure with reference to FIGS. 1 to 13. In the figures, the same element or elements which have similar functions are indicated by the same reference signs.

FIG. 1 is an exemplary embodiment of the present disclosure which illustrates a perspective view of an apparatus (100) for forming plurality of surface protrusions (2) which improves yield strength of one or more workpieces (1).

Figure 2A:
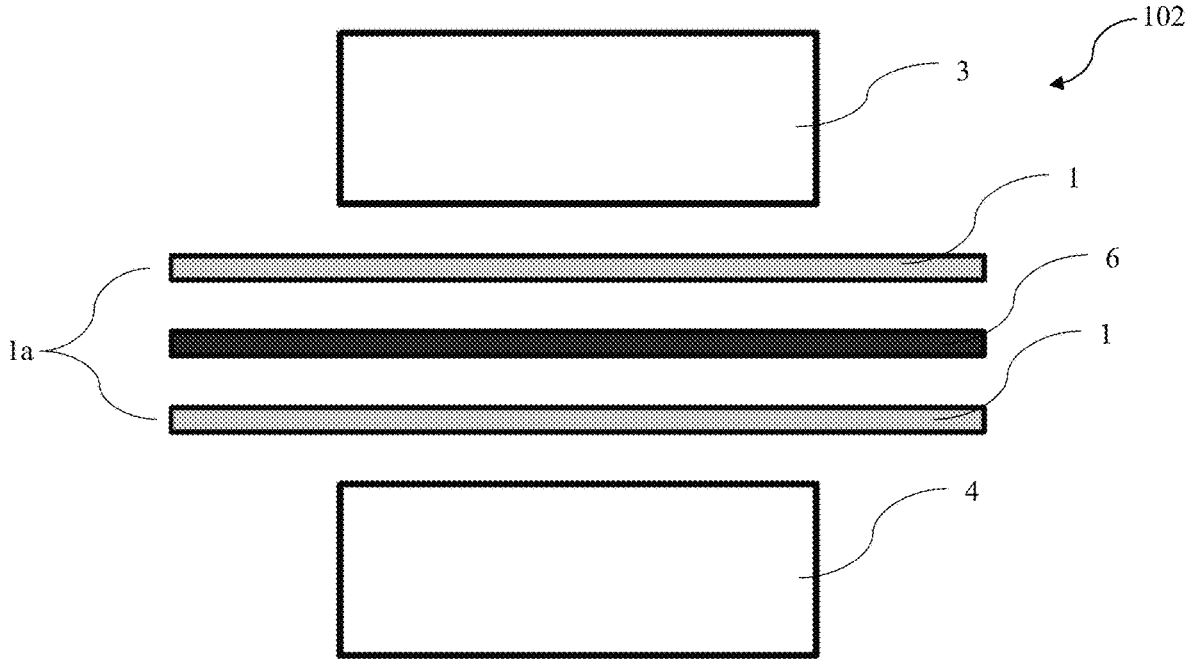
Figure 2B:
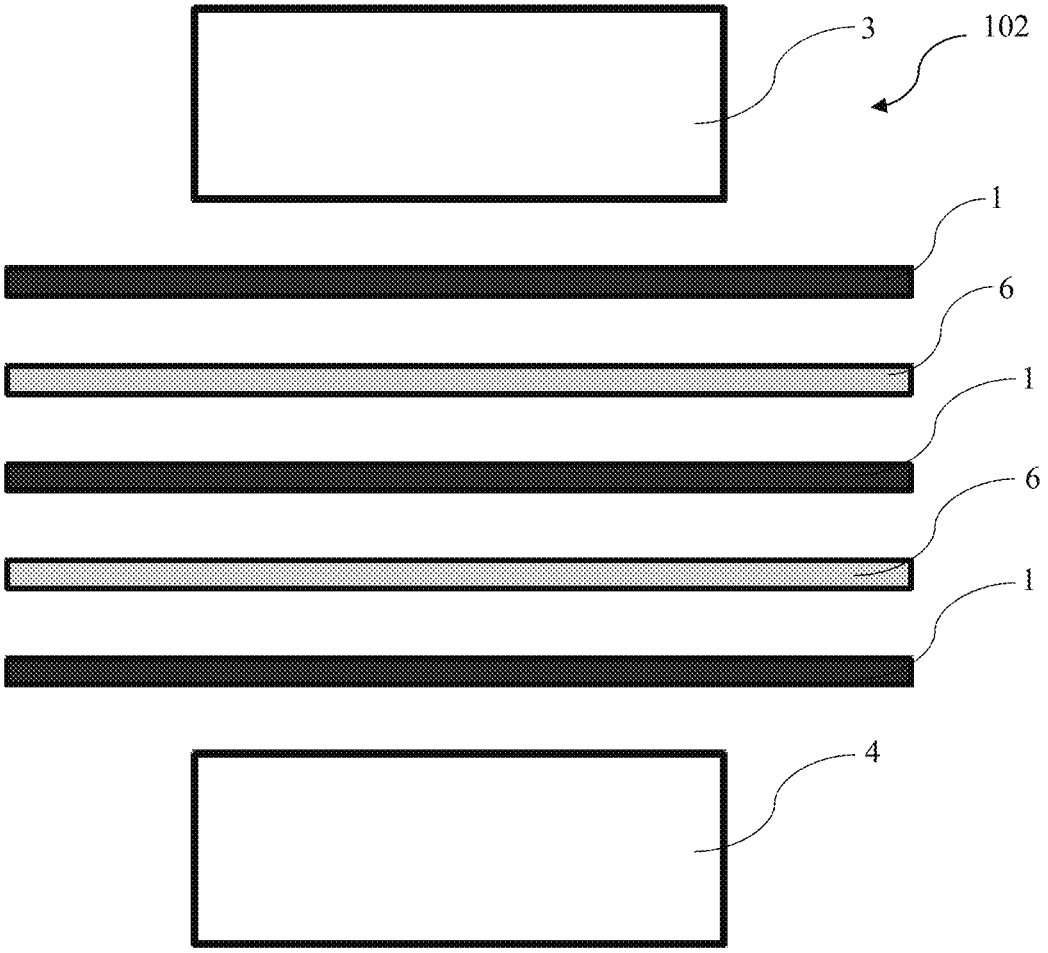

The apparatus (100) comprises a punch and die assembly (102) [as shown in FIGS. 2*a* and 2*b*] configured to be mountable on a press (101) such as a hydraulic press or a pneumatic press.

The punch and the die assembly (102) comprises a top bolster (101*a*) connectable to a punch (3) and a bottom bolster (101*b*) connectable to a die (4). The die (4) is configured to receive and position the one or more workpieces (1) in the punch and die assembly (102). This configuration enables to form a plurality of surface protrusions (2) on the one or more workpieces (1) upon operation of the punch and die assembly (102). The plurality of surface protrusions (2) are formed by plastic deformation of the one or more workpieces (1), to improve yield strength.

The apparatus (100) includes at least one template mesh (6) [as shown in FIGS. 2*a* and 2*b*] is selectively provided on at least one surface (la) of the one or more workpieces (1) to form the plurality of surface protrusions (2). The at least one surface (la) may refer to any surface on the one or more workpieces (1) feasible for forming the plurality of surface protrusions (1), based on cross-section of the one or more workpieces (1). As an illustration, the at least one surface (la) in FIGS. 2*a* and 2*b* refers to top surfaces of the one or more workpieces (1). In an embodiment, the at least one template mesh (6) may be provided above the one or more workpieces (1) for forming the plurality of surface protrusions (2) [shown in FIG. 2*a*].

Figure 3:
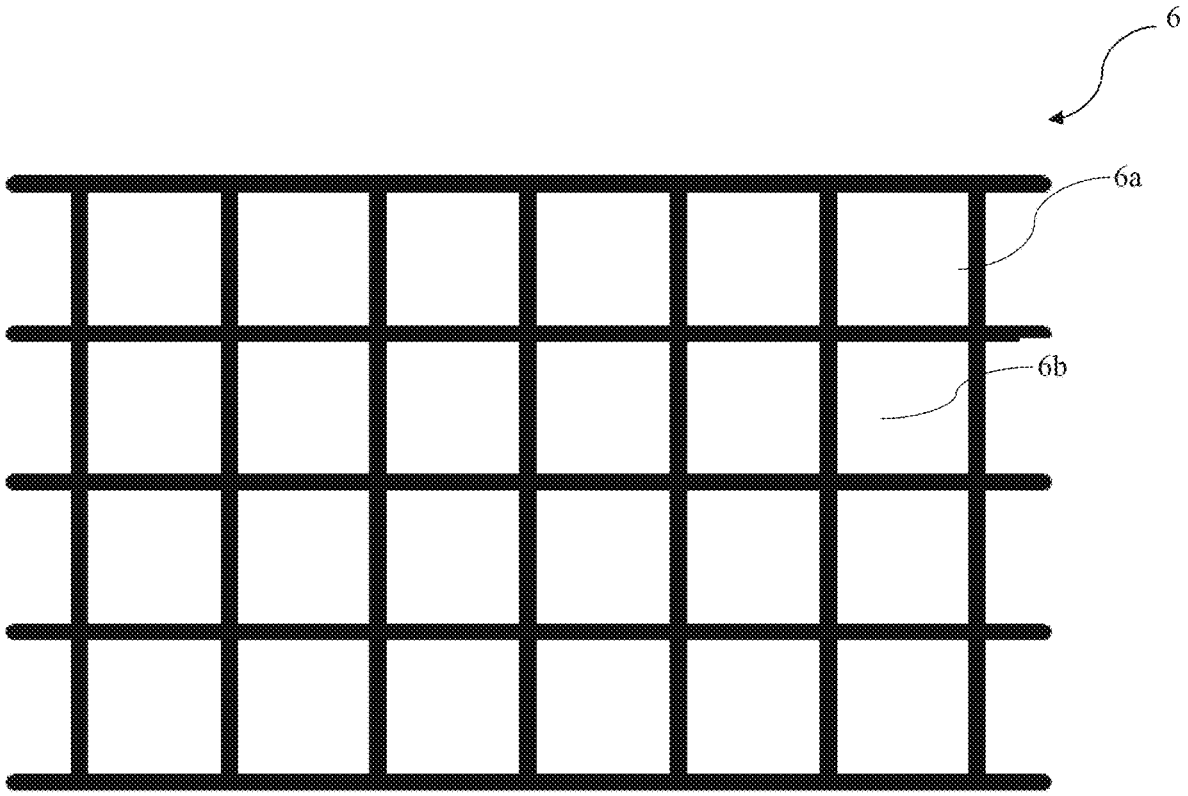
FIG. 3 illustrates at least one template mesh, in accordance with an embodiment of the present disclosure.

Referring to FIG. 3, an enlarged view of the at least one template mesh (6) is illustrated. The at least one template mesh (6) includes a plurality of wires (6*a*) interconnected to one another. The plurality of wires (6*a*) may be interconnected in a criss-cross configuration to form the at least one template mesh (6). In an embodiment, the criss-cross configuration may be obtained by weaving or welding the plurality of wires (6*a*) in-straight intersecting lines to form the at least one template mesh (6). Since the plurality of wires (6*a*) are woven or welded in-straight intersecting lines, a plurality of voids (6*b*) are formed between each interconnection of the plurality of wires (6*a*). The plurality of voids (6*b*) allows the surface of the one or more workpieces (1) to protrude, while the interconnected edges of the plurality of wires (6*a*) may act as a means for creating depressions or plurality of troughs by plastic deformation on the one or more workpieces (1). This configuration therefore, ensures that the plurality of surface protrusions (2) are formed having a plurality of troughs (2*a*) and a plurality of crests (2*b*) [shown in FIG. 7].

Figure 4:
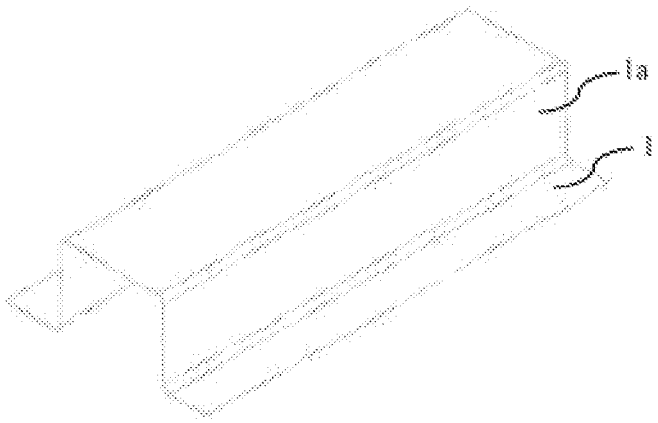
FIG. 4 illustrates the one or more workpieces, in accordance with an embodiment of the present disclosure.
Figure 5:
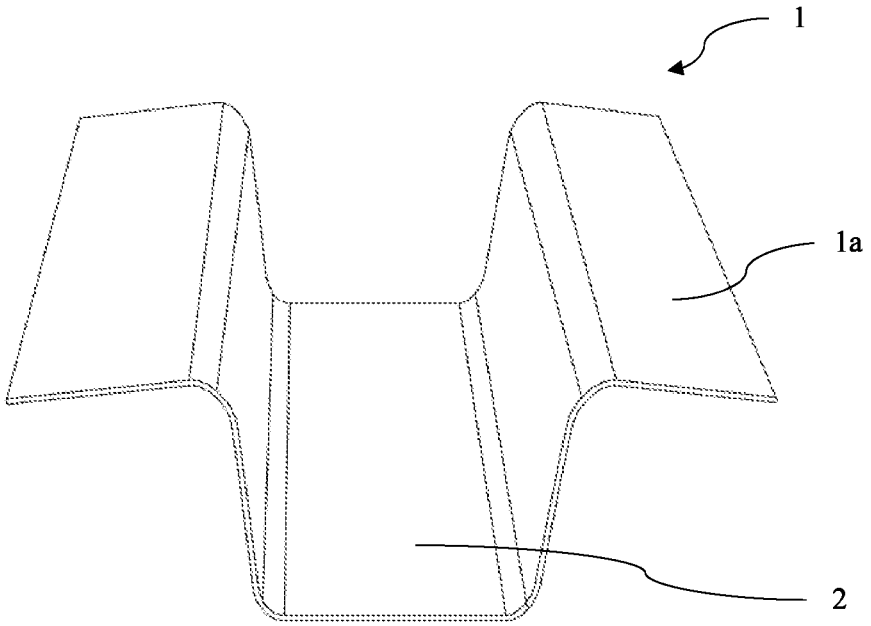
FIG. 5 illustrates the one or more workpieces formed with a plurality of surface protrusions, in accordance with an embodiment of the present disclosure.

In an exemplary embodiment, a hat profiled workpiece [as shown in FIG. 4] is disclosed. The at least one template mesh (6) may be provided on an inner surface of the one or more workpieces (1) to form the plurality of surface protrusions (2) on the inner surface of the one or more workpieces (1) [as shown in FIG. 5]. Further, the at least one template mesh (6) may be provided on any of the at least one surface (la) of the one or more workpieces (1) to form the plurality of surface protrusions (2) on the one or more workpieces (1). The at least one template mesh (6) may also be provided on a portion of the at least one surface (la) of the one or more workpieces (1) to form the plurality of surface protrusions (2). The at least one template mesh (6) imprints the plurality of surface protrusions (2) on the one or more workpieces (1) upon application of load via the punch and die assembly (102). The at least one template mesh (6) may be configured with a material strength greater than the one or more workpieces (1), to prevent deformation of the at least one template mesh (6) on the one or more workpieces (1) upon application of load.

The at least one template mesh (6) may be formed with the plurality of wires (6*a*) of predetermined cross-section. The cross-section of the plurality of wires (6*a*) may be selected based on the configuration of the plurality of troughs (2*a*) required on the one or more workpieces (1). The cross-section of the plurality of wires (6*a*) may be selected from group such as, but not limiting to, a square cross-section, a rectangular cross-section, a circular cross-section and the like. As an example, if the required configuration of the plurality of troughs (2*a*) is rectangular, the plurality of wires (6*a*) of rectangular cross-section may be used to form the at least one template mesh (6). Thus, upon application of load on the at least one template mesh (6), rectangular depressions are formed, thereby forming the plurality of troughs (2*a*) with rectangular configuration. As an example, if the required configuration of the plurality of crests (2*b*) are rectangular, the plurality of wires (6*a*) are interconnected so that a rectangular plurality of voids (6*b*) are formed in-between each interconnected wire. Thus, application of load on this configuration of the at least one template mesh (6) ensures formation of the plurality of crests (2*b*) of rectangular configuration. In an embodiment, the size of the plurality of voids (6*b*) may vary in the range of about 10 microns to about 110 microns as per feasibility and requirement. In an embodiment, the size of the plurality of wires (6*a*) may vary in the range of about 15 microns to about 100 microns as per feasibility and requirement.

In an embodiment, providing the at least one template mesh (6) on the one or more workpieces (1) may refer to the at least one template (6) fastened on the one or more workpieces (1) to prevent misalignment during operation of the punch and die assembly (102). The at least one template mesh (6) may also be mountable on at least one of the punch (3) and the die (4), to ensure formation of the plurality of surface protrusions (2) on the one or more workpieces (1) without providing the at least one template mesh (6) on the one or more workpieces (1). A slot [not shown in Figures] may be provided to at least one of the punch (3) and the die (4) for receiving and holding the at least one template mesh (6). A fastening mechanism [not shown in Figures] such as a bolt and nut arrangement, a snap-fit arrangement and the like may be provided to at least one of the punch (3) and the die (4) for receiving and holding the at least one template mesh (6). This configuration, ensures cassette type replacement of the at least one template mesh (6) in at least one of the punch (3) and the die (4), based on design requirement of the plurality of protrusions (2) formed on the one or more workpieces (1). Further, this configuration also ensures that, bare or plain configuration of the punch (3) and the die (4) may also imprint the plurality of surface protrusions (2) by utilising the configuration of the at least one template mesh (6).

In an embodiment, configuration of the at least one template mesh (6) may be defined on at least one of the punch (3) and the die (4), so that the plurality of surface protrusions (2) are formed on the one or more workpieces (1), even in the absence of the at least one template mesh (6). The configuration defined on the at least one of the punch (3) and the die (4), may be at least one of a plurality of protrusions (7) and a plurality of cavities (8), based on feasibility and requirement. The plurality of protrusions (7) and the plurality of cavities (8) are defined on the punch (3) and the die (4) to be complementary to each other, for feasibility of forming the plurality of surface protrusions (2). In an exemplary embodiment, the plurality of protrusions (7) are defined on the punch (3) and the plurality of cavities (8) are defined on the die (4), to form the plurality of surface protrusions (2) on one surface of the one or more workpieces (1). Alternatively, the plurality of protrusions (7) are defined on the die (4) and the plurality of cavities (8) are defined on the punch (3), to form the plurality of protrusions (3) on another surface of the one or more workpieces (1). In another embodiment, the plurality of protrusions (7) and the plurality of cavities (8) may be defined on the punch (3) and the die (4) complementarily to one another, so that each portion of the one or more workpieces (1) are induced with different configuration of the plurality of surface protrusions (2). Further, the size of the plurality of protrusions (7) [height] and the plurality of cavities (8) are corresponding to the size of the at least one template mesh (6). This configuration ensures that the plurality of surface protrusions (2) obtained by operation of the punch (3) and the die (4) corresponds to that of the plurality of surface protrusions (2) obtained by the at least one template mesh (6).

In an embodiment, the die (4) includes a securing means [not shown in Figures] for securely positioning the one or more workpieces (1) during operation of the punch and die assembly (102), to prevent unintended movement. In an embodiment, the securing means may be selected from at least one of fasteners, a snap-fit arrangement and the like which serves the purpose of securing the one or more workpieces (1). In an embodiment, the die (4) may include a support member (5) for holding the one or more workpieces (1).

In an embodiment, the top bolster (101*a*) and the bottom bolster (101*b*) of the press (101) includes a mechanism [now shown in Figures] for connecting the punch (3) and the die (4) before use. This mechanism, enables to detach the punch (3) and the die (4), during non-operational condition of the apparatus (100). In an embodiment, different punch (3) and die (4) combinations, for forming the plurality of surface protrusions (2), based on feasibility and requirement may be mounted to the press (101). The mechanism may be selected from at least one of a fastening mechanism, a snap-fit mechanism, a sliding mechanism or any other mechanism which serves the purpose of connecting the punch (3) to the top bolster (101*a*) and the die (4) to the bottom bolster (101*b*).

In an embodiment, the one or more workpieces (1) may be selected with material properties including sufficient ductility so that, the one or more workpieces (1) can undergo plastic deformation, instead of fracture upon loading. Further, the one or more workpieces (1) is selected from at least one of a steel sheet, an aluminium sheet, a stainless-steel sheet or any other sheet that serves the requirement. Also, the one or more workpieces (1) is selected from at least one of a bare workpiece, a forming workpiece, a formed workpiece, a heat-treated workpiece or any other workpiece.

In an embodiment, the plurality of surface protrusions (2) are formed due to the strain hardening effect induced by the plastic deformation. The strain hardening induces size effect on the surface of the one or more workpieces (1), thereby forming a configuration including the plurality of troughs (2*a*) and the plurality of crests (2*b*). This configuration ensures that the surface available for receiving or contacting the load is minimised, thereby preventing deformation, which inherently improves yield strength of the one or more workpieces (1).

In an embodiment, the size of the plurality of voids (6*b*) of the at least one template mesh (6) ranges from about 20 microns to about 1000 microns. The size of the plurality of wires (6*a*) ranges from about 20 microns to about 500 microns.

In an embodiment, the one or more workpieces (1) may be a sheet material with thickness ranging from about 0.25 mm to about 2 mm. In another embodiment, the one or more workpieces (1) may be selected from at least one of a hot-rolled sheet material and a cold-rolled sheet material.

In an embodiment, the punch (3) and the die (4) may be made of tool grade steel material, which is harder than the one or more workpieces (1).

Figure 6:
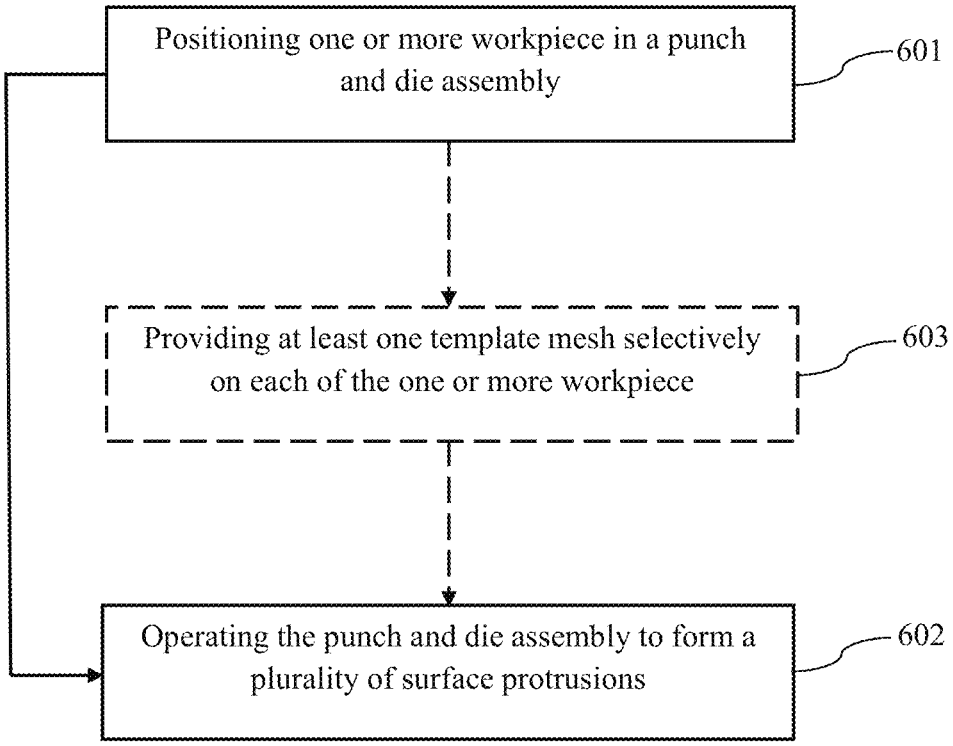
FIG. 6 illustrates a flow chart of a method for improving yield strength of the one or more workpieces, in accordance with an embodiment of the present disclosure.

FIG. 6 in one exemplary embodiment of the present disclosure, illustrates a flow chart of a method for improving yield strength of one or more workpieces (1).

In step 601 the one or more workpieces (1) is positioned securely in the punch and the die assembly (102), by the suitable mechanism, to prevent misalignment during operation of the punch and die assembly (102).

Figure 7:
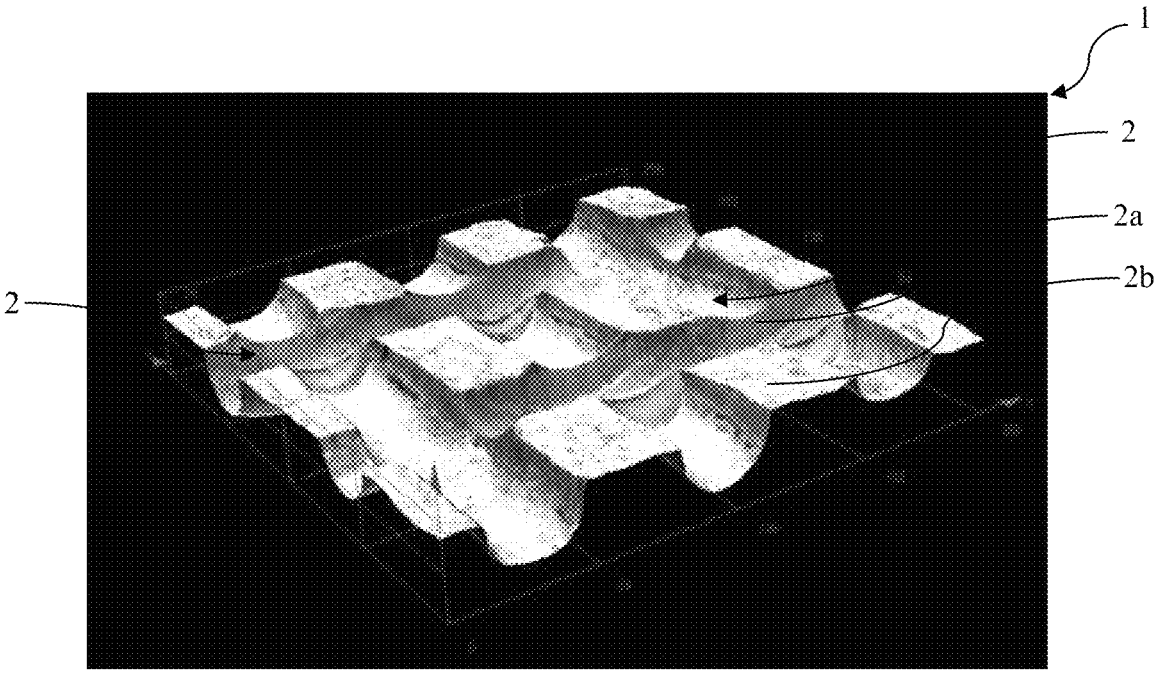
FIG. 7 illustrates a microscopic view of a portion of the plurality of surface protrusions formed on the one or more workpieces, in accordance with an embodiment of the present disclosure.

In step 602, the punch and die assembly (102) is operated by the press (101) to displace the punch towards the die (4). Operation of the punch and die assembly (102) includes stamping by the punch (3) on the at least one template mesh (6), for imprinting the plurality of troughs (2*a*) over the at least one surface (la) of the one or more workpieces (1). The plurality of troughs (2*a*) are formed due to plastic deformation of the one or more workpieces (1) by application of the load. The plurality of troughs (2*a*) formed over the at least one surface (la) induces the plurality of crests (2*b*) adjacent to the plurality of troughs (2*a*) hence forming the plurality of surface protrusions (2) [as shown in FIG. 7]. The plurality of surface protrusions (2) may be formed corresponding to the configuration of the punch (3) and the die (4). In an embodiment, the plurality of troughs (2*a*) and the plurality of crests (2*b*) formed over the at least one surface (la) is configured to be at least one of symmetrical configuration and asymmetrical configuration. That is, the size of the plurality of the troughs (2*a*) and the plurality of crests (2*b*) on the one or more workpieces (1) may be equal or unequal based on design feasibility and requirement.

In step 603, the at least one template mesh (6) may be provided in the punch and die assembly (102) such that, the at least one template mesh (6) may be placed selectively on the at least one surface (la) of the one or more workpieces (1). The at least one template mesh (6) is configured to imprint a texture of its configuration on the at least one surface (la), to form the plurality of surface protrusions (2). The provision of the at least one template mesh (6) mitigates the need for defining the plurality of protrusions (7) and the plurality of cavities (8) on at least one of the punch (3) and the die (4). This provision therefore, further simplifies the process of imprinting the plurality of protrusions (2) on the at least one surface (la) of the one or more workpieces (1).

In an embodiment, the one or more workpieces (1) may be positioned in the punch and the die assembly (102) either manually by a user or automatically by a robot in step 101.

Figure 8:
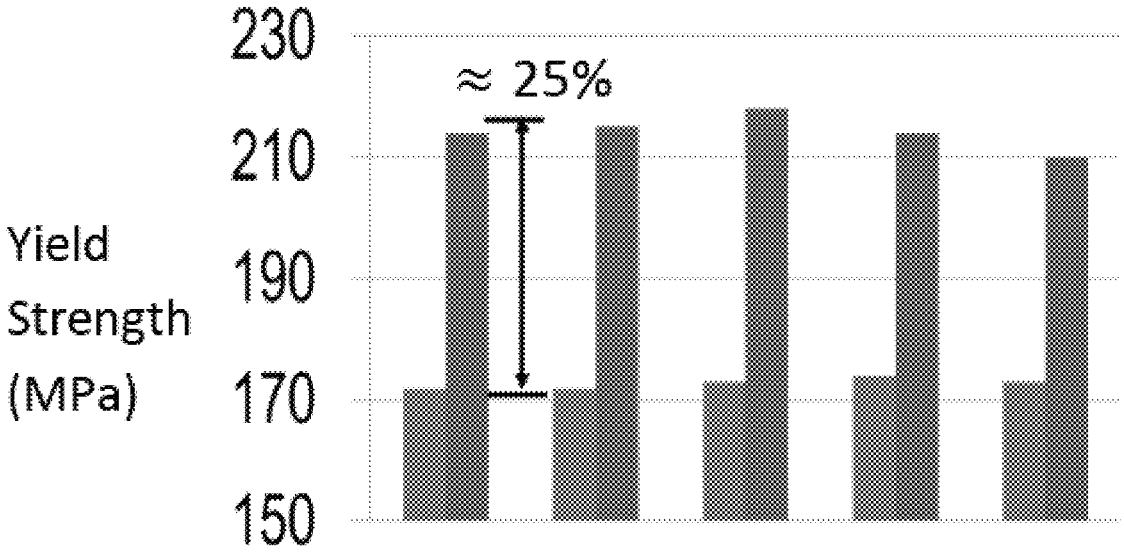
FIG. 8 illustrates a comparison chart of increase in yield strength of the one or more workpieces with the plurality of surface protrusions, in accordance with an embodiment of the present disclosure.
Figure 9:
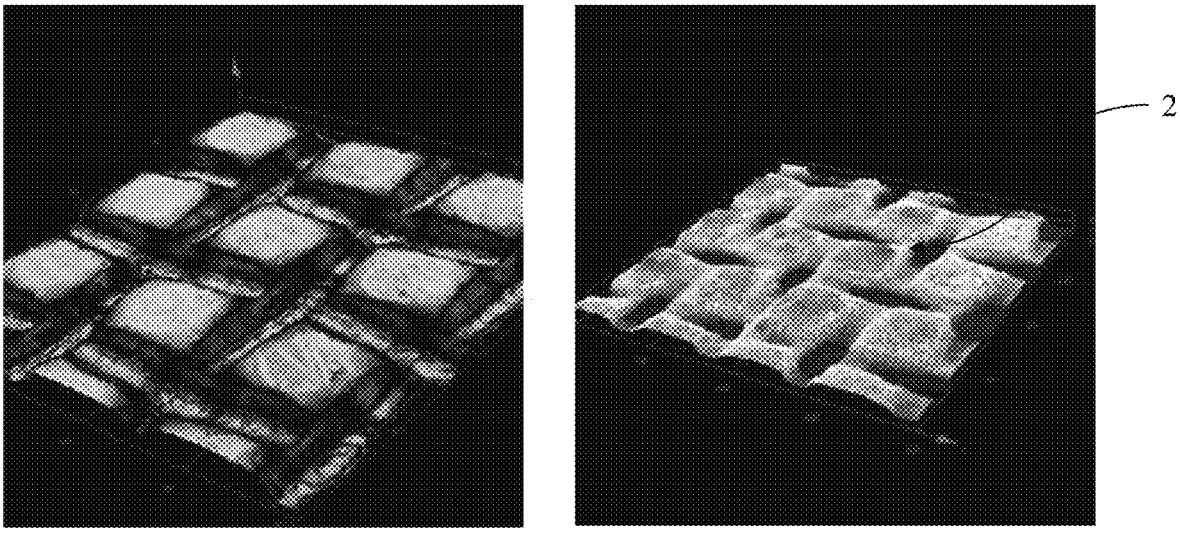
FIG. 9 illustrates microscopic view of a portion of the plurality of surface protrusions formed on the one or more workpieces, in accordance with an embodiment of the present disclosure.
Figure 10:
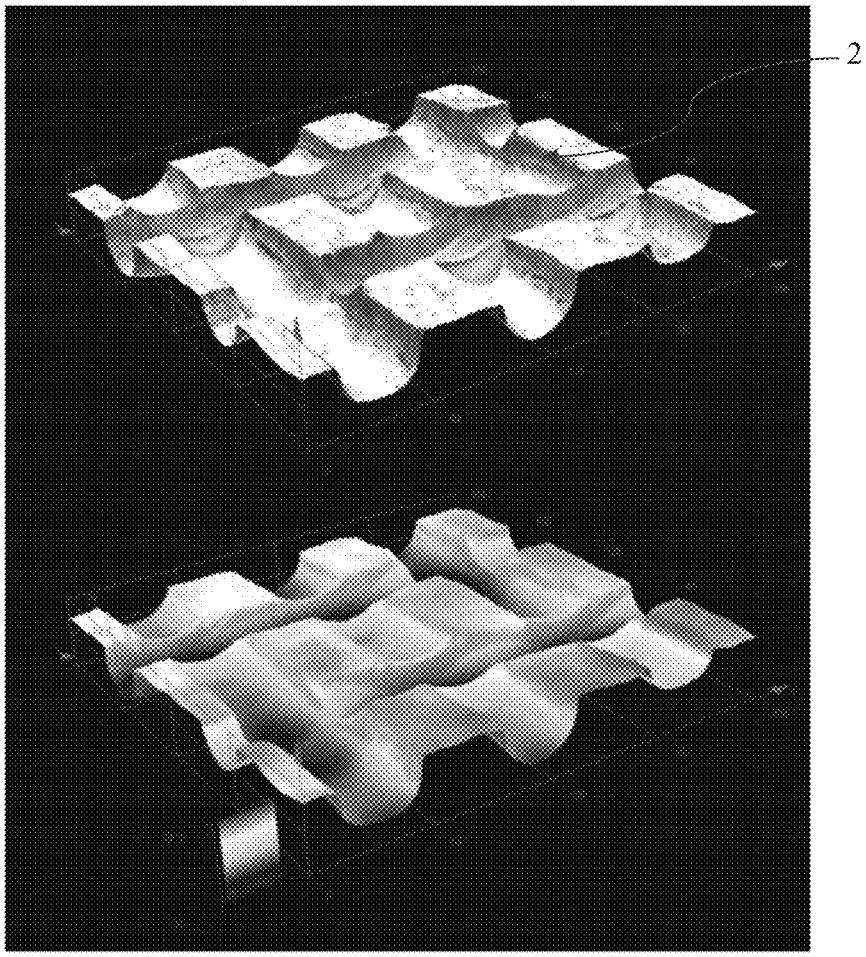
FIG. 10 illustrates a microscopic view of a portion of the plurality of surface protrusions formed on the one or more workpieces, in accordance with an embodiment of the present disclosure.
Figure 11:
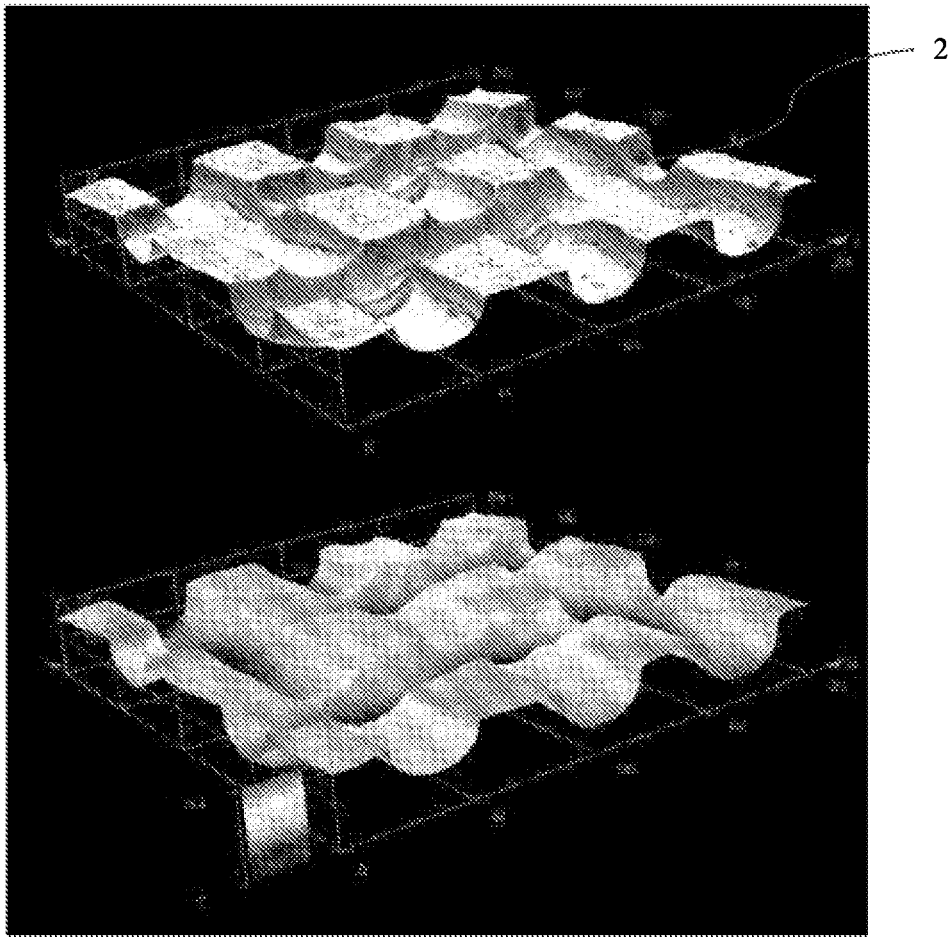
FIG. 11 illustrates a microscopic view of a portion of the plurality of surface protrusions formed on the one or more workpieces, in accordance with an embodiment of the present disclosure.
Figure 12:
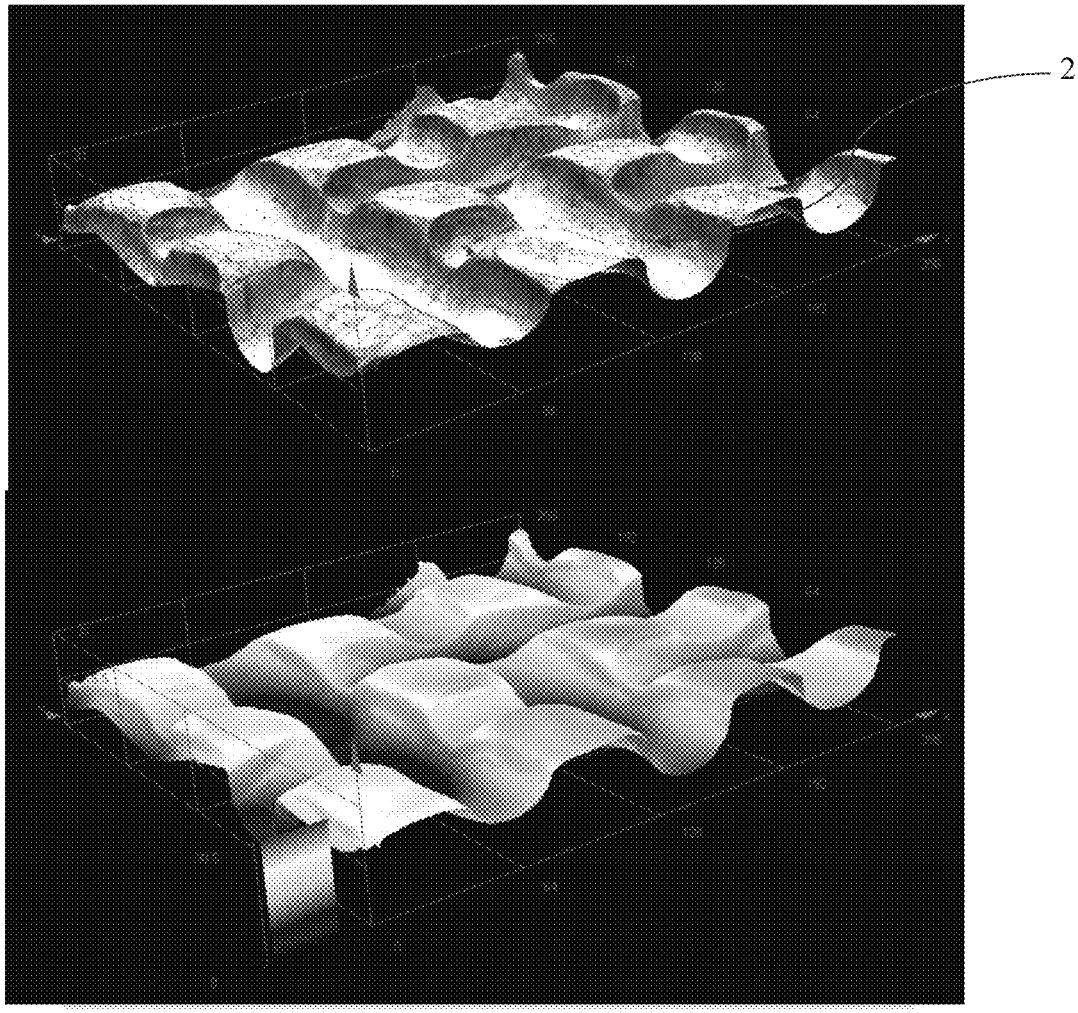
FIG. 12 illustrates a microscopic view of a portion of the plurality of surface protrusions formed on the one or more workpieces, in accordance with an embodiment of the present disclosure.

Referring to FIG. 8 in conjunction to FIG. 1, the improvement in yield strength of the one or more workpieces (1) is graphically illustrated. As per the representation, provision of the plurality of surface protrusions (2) on the one or more workpieces (1) has significantly improved its yield strength by approximately 25%, with the reduction in thickness of the one or more workpieces (1) being less than 1%. Formation of the plurality of troughs (2*a*) due to plastic deformation leads to compaction [plastic strain] of the one or more workpieces (1). Such compaction at the formation of plurality of troughs (2*a*) increases concentration of the material molecules in this region, thereby improving yield strength of the one or more workpieces (1). The improvement of yield strength of the one or more workpieces (1) is due to the phenomenon of strain hardening, which further induces the size effect phenomenon. In an embodiment, the plurality of surface protrusions (2) improve the yield strength of the one or more workpieces (1) by at least 10%. In an embodiment, dimensions of the plurality of surface protrusions (2) varies in the range of about 5 microns to about 100 microns and pitch [distance between each of the plurality of surface protrusions] of the plurality of surface protrusions (2) varies in the range of about 10 microns to about 1000 microns.

Exemplary Experimental Results:

Based on the method for improving yield strength of the one or more workpieces (1) as described above, comparison of mechanical properties of the one or more workpieces (1) after forming the plurality of surface protrusions (2) is conducted. The comparison is conducted on different grades of one or more workpieces (1).

The parameters pertaining to the comparison of mechanical properties is tabulated in Table 1, provided below.

TABLE 1

| Grade | Avg Prior Yield strength (MPa) | Avg Yield strength after creation of protrusions on one side (MPa) | % improvement in Yield Strength | Avg Yield strength after creation of protrusions on both side (MPa) | % improvement in Yield Strength | Change in UTS (Yes/No) | % Change in Elongation (after surface protrusions) |
|---|---|---|---|---|---|---|---|
| Ultra Low Carbon | 172 | 214 | 24.4 | 236 | 37 | No | <2 |
| Multi Phase | 350 | 397 | 13.4 | 424 | 21.1 | No | <2 |
| Micro Alloyed | 355 | 396 | 11.5 | 420 | 18.3 | No | <2 |

The comparison includes two sets of experiments. The first set of experiments are carried out on rectangular samples of the one or more workpieces (1) with dimensions 10 mm*15 mm*0.6 mm. Second set of experiments are performed on the uniaxial tensile test samples. The dimensions of the sample are as per the ASTM-E6 standard.

First Set of Experiments:

In this test, 100 μm square shaped plurality of surface protrusions (2) are formed with height ranging from 30 μm to 50 μm. A predefined punch load is selected enough to produce average compressive stress equivalent to three times the yield strength of the one or more workpieces (1). The results are tabulated below in table 2.

TABLE 2

| | Material: Ultra low carbon steel | | |
|---|---|---|---|
| Sample dimension | Compressive load | Average stress on the surface | Mesh size |
| 10 mm × 15 mm × 0.6 mm | 67 KN | 2.5 times yield strength | 100 μm |
| 10 mm × 15 mm × 0.6 mm | 67 KN | 2.5 times yield strength | 35 μm |
| 20 mm × 10 mm × 0.7 mm | 85 KN | 2.5 times yield strength | 100 μm |
| 20 mm × 10 mm × 0.7 mm | 85 KN | 2.5 times yield strength | 35 μm |

The plurality of surface protrusions (2) produced with regards to the one or more workpieces (1) of table 1, is illustrated in FIGS. 9-12. The images of the plurality of surface protrusions (2) captured using the optical microscope at 500× for 35 nm micro-pillar.

As illustrated in the table 1 and the FIGS. 9-12, it is evident that formation of the plurality of surface protrusions (2) has improved yield strength of the one or more workpieces (1) by at least 10%.

Further, a set of uniaxial tensile testing was carried out to characterize the improvement of the yield strength of the one or more workpieces (1) after the plurality of surface protrusions (2) are obtained on these samples.

Second Set of Experiments:

The physical property considered in this study is yield strength of the one or more workpieces (1). The one or more workpieces (1) is tested on the ASTM-E8 standard sample with width of the gauge area 12.5. The process parameters are tabulated in table 3 and results are tabulated in table 4.

TABLE 3

| | Material: Ultra low carbon steel | | | | |
|---|---|---|---|---|---|
| Sample Type | Sample dimension (gauge width) | Thickness | Compressive load | Average stress on the surface | Mesh size |
| 1 | 12.5 mm | 0.8 mm | 450 KN | 1.33 times yield strength | 100 μm |
| 2 | 12.5 mm | 0.8 mm | 450 KN | 1.33 times yield strength | 35 μm |

TABLE 4

| Sample Number | Avg Prior Yield strength | Avg Yield strength after creation of protrusions | % improvement in Yield Strength |
|---|---|---|---|
| 1 | 180 MPa | 210 MPa | 16.7% |
| 2 | 181 MPa | 211 MPa | 16.6% |

From the data collated in tables 3 and 4, it is evident that formation of the plurality of surface protrusions (2) on the one or more workpieces (1) improves the yield strength by at least 10% in comparison with the one or more workpieces (1) without the plurality of surface protrusions (2).

Figure 13:
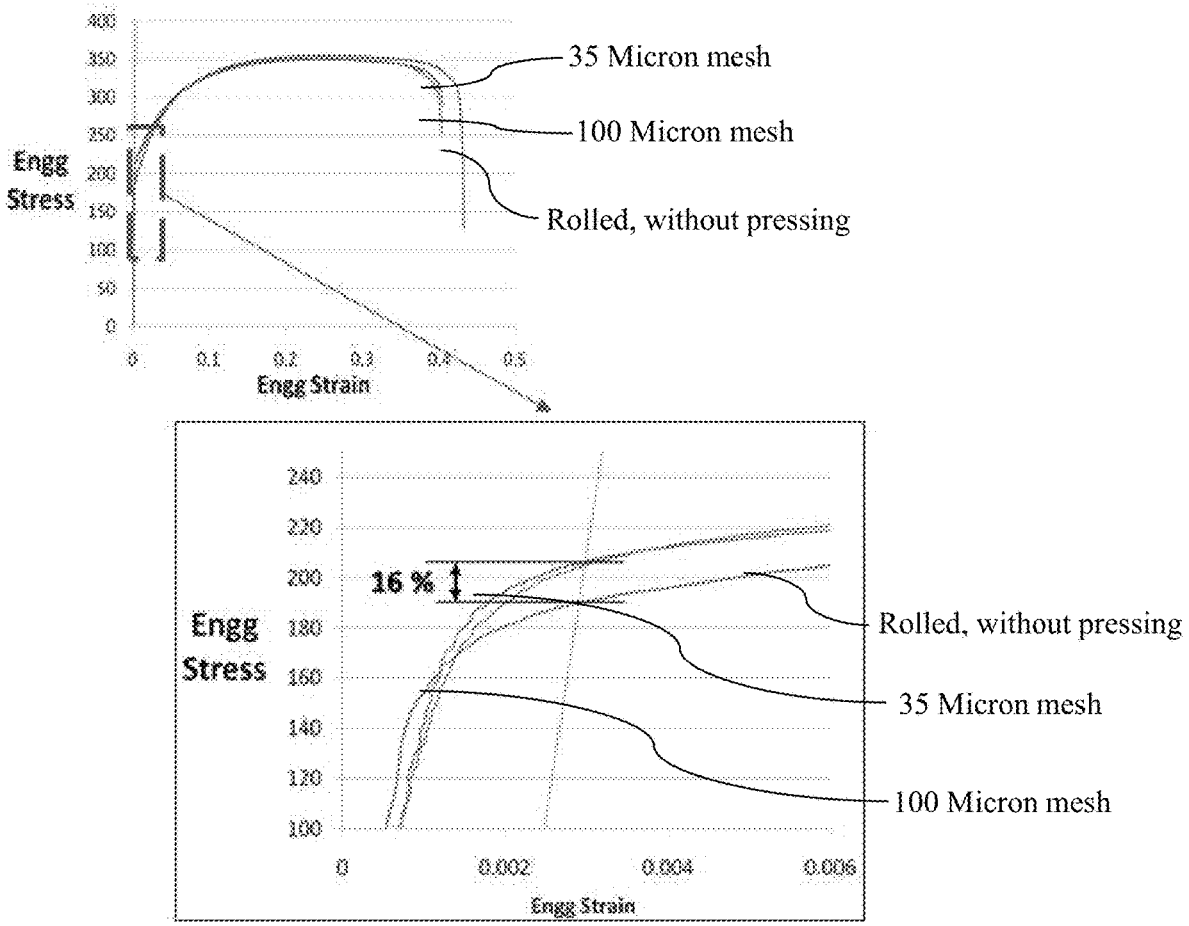
FIG. 13 illustrates a graphical representation of the mechanical behaviour of the one or more workpieces of FIGS. 9, 10, 11 and 12 upon loading, in accordance with an embodiment of the present disclosure.

Referring to FIG. 13, a graphical representation of yield strength of one or more workpieces (1) with the plurality of surface protrusions (2) of mesh sizes 100 microns and 35 microns is compared with a rolled one or more workpieces (1). It is evident from the graph that, the yield strength of the one or more workpieces (1) with the plurality of surface protrusions (2) is greater than the yield strength of the rolled one or more workpieces (1). Also, it is noticeable that the yield strength of the one or more workpieces (1) having lower protrusions is lower in comparison to the same for one or more workpieces (1) with deep protrusions. The data for such variations in micro alloyed steel is tabulated in Table 5.

TABLE 5

| Height of the plurality of surface protrusions (μm) | Strength achieved (MPa) |
|---|---|
| 22 | 370 |
| 25 | 379 |
| 33 | 380 |
| 38 | 408 |
| 40 | 423 |

Though the description and the embodiments demonstrate results pertaining to yield strength, the description can also be extended to any other parameter such as flow strength.

Advantages

The present disclosure provides a method for improving yield strength of one or more workpieces by forming a plurality of surface protrusions.

The present disclosure provides a cost-effective method for improving yield strength of one or more workpieces.

The present disclosure provides the method to improve yield strength of the one or more workpieces by at least 10% than the bare or conventional workpiece, without etching or removal of the one or more workpieces.

The present disclosure provides the method to improve physical and mechanical properties of the workpiece at desired locations.

The present disclosure provides a method for improving yield strength, particularly where higher strength is desirable post forming the components, such as automobiles panels.

EQUIVALENTS

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances, where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

REFERRAL NUMERALS

| Referral numerals | Description |
|---|---|
| 100 | Apparatus for improving yield strength of one or more workpieces |
| 101 | Press |
| 102 | Punch and die assembly |
| 1 | One or more workpieces |
| 2 | Plurality of surface protrusions |
| 2a | Plurality of troughs |
| 2b | Plurality of crests |
| 3 | Punch |
| 4 | Die |
| 5 | Support member |
| 6 | At least one template mesh |
| 6a | Plurality of wires |
| 6b | Plurality of voids |
| 7 | Plurality of protrusions |
| 8 | Plurality of cavities |

We claim:

1. A method for improving yield strength of one or more workpieces, comprising:

positioning the one or more workpieces in a punch and die assembly;

providing at least one template mesh selectively on at least one surface of each of the one or more workpieces; and operating the punch and die assembly such that, a plurality of surface protrusions are formed on the one or more workpieces, wherein the plurality of surface protrusions formed by plastic deformation on the one or more workpieces, improves yield strength of the one or more workpieces, wherein the at least one template mesh includes a plurality of wires interconnected in a criss-cross configuration to define a plurality of voids for forming of the plurality of surface protrusions on the one or more workpieces.

2. The method as claimed in claim 1, wherein operating the punch and die assembly includes stamping, for imprinting a texture of a plurality of troughs over the at least one surface of the one or more workpieces and formation of the plurality of troughs induces a plurality of crests adjacent to the plurality of troughs, to form the plurality of surface protrusions, wherein the plurality of troughs and the plurality of crests are configured to be at least one of symmetrical configuration and asymmetrical configuration.

3. The method as claimed in claim 2, wherein stamping includes imprinting configuration of the at least one template mesh over the at least one surface of the one or more workpieces and operating the punch and the die assembly stamps the one or more workpieces to form the plurality of troughs, thereby forming the plurality of surface protrusions.

4. The method as claimed in claim 3, wherein stamping of at least one of the plurality of protrusions and the plurality of cavities on at least one of the punch and the die forms the plurality of surface protrusions on the one or more workpieces.

5. The method as claimed in claim 1, wherein configuration of the at least one template mesh is defined on a punch and the configuration of the punch includes at least one of a plurality of protrusions and a plurality of cavities.

6. The method as claimed in claim 1, wherein configuration of the at least one template mesh is defined on a die and the configuration of the die includes at least one of the plurality of protrusions and the plurality of cavities.

7. The method as claimed in claim 1, wherein the at least one template mesh is provided between each of the one or more workpieces and the configuration of the at least one template mesh is selected from at least one of a square configuration, a triangular configuration, a rectangular configuration or any other configurations thereof.

8. The method as claimed in claim 1, wherein providing the at least one template mesh includes, mounting the at least one template mesh on at least one of the punch and the die to form the plurality of surface protrusions and the at least one template mesh is detachable from at least one of the punch and the die.

9. The method as claimed in claim 1, wherein formation of the plurality of surface protrusions on the one or more workpieces improves yield strength of the one or more workpieces by at least 10%, in comparison to the one or more workpieces without the plurality of surface protrusions.

10. The method as claimed in claim 1, wherein the one or more workpieces is selected from at least one of a steel sheet, an aluminum sheet, a stainless-steel sheet, a bare workpiece, a forming workpiece, a formed workpiece, a heat-treated workpiece or any other workpiece thereof.

11. The method as claimed in claim 1, wherein dimensions of the plurality of surface protrusions varies in the range of about 5 microns to about 100 microns, and pitch of the plurality of surface protrusions varies in the range of about 10 microns to about 1000 microns.

12. A workpiece, wherein the workpiece is processed by the method as claimed in claim 1 and comprises: comprising:

a plurality of surface protrusions formed by plastic deformation induced by operating a punch and die assembly, wherein the plurality of surface protrusions includes a plurality of troughs, and wherein the workpiece is configured with an increased yield strength of at least 10% in comparison to the workpiece without the plurality of surface protrusions.

13. An apparatus for improving yield strength of one or more workpieces, the apparatus comprising:

a punch and die assembly mountable on a press, the punch and die assembly comprising:

a top bolster connected to a punch, at least one template mesh selectively on at least one surface of each of the one or more workpieces, and a bottom bolster connected to a die, the die is configured to position one or more workpieces, such that a plurality of surface protrusions are formed on the one or more workpieces upon operating the punch and die assembly, wherein the plurality of surface protrusions formed by plastic deformation on the one or more workpieces improves yield strength of the one or more workpieces wherein the at least one template mesh includes a plurality of wires interconnected in a criss-cross configuration to define a plurality of voids for forming of the plurality of surface protrusions on the one or more workpieces.

14. The apparatus as claimed in claim 13, comprises at least one template mesh provided selectively on at least one surface of the one or more workpieces or the at least one template mesh is mountable on at least one of the punch and the die to form the plurality of surface protrusions and the configuration of the at least one template mesh is a square configuration, a triangular configuration, a circular configuration, a rectangular configuration or any other configurations thereof.

15. The apparatus as claimed in claim 14, wherein the at least one template mesh imprints a texture of a plurality of troughs on the at least one surface of the one or more workpieces, upon operation of the punch and die assembly and the at least one template mesh is detachable from at least one of the punch and the die.

16. The apparatus as claimed in claim 14, wherein configuration of the at least one template mesh is defined on the punch and the configuration of the punch includes at least one of a plurality of protrusions and a plurality of cavities.

17. The apparatus as claimed in claim 14, wherein configuration of the at least one template mesh is defined on the die and the configuration of the die includes at least one of the plurality of protrusions and the plurality of cavities.

18. The apparatus as claimed in claim 13, wherein formation of the plurality of surface protrusions on the one or more workpieces improves yield strength of the one or more workpieces by at least 10%, in comparison to the one or more workpieces without the plurality of surface protrusions.

19. The apparatus as claimed in claim 13, wherein dimensions of the plurality of protrusions vary in the range of about 5 microns to about 100 microns.

* * * * *